US005282550A

United States Patent [19]

Coleman

[11] Patent Number: 5,282,550

[45] Date of Patent: Feb. 1, 1994

[54] BULK MATERIAL CONTAINER WITH A FLEXIBLE LINER

[75] Inventor: Clarence B. Coleman, Oakland, Calif.

[73] Assignee: Fabricated Metals, Inc., San Leandro, Calif.

[21] Appl. No.: 972,723

[22] Filed: Nov. 6, 1992

Related U.S. Application Data

[63] Continuation of Ser. No. 718,248, Jun. 20, 1991, abandoned.

[51] Int. Cl.[5] ..... B65D 35/56

[52] U.S. Cl. ..... 222/105; 222/185

[58] Field of Search ..... 222/95, 105, 131, 181, 222/185, 183, 386.5

[56] References Cited

U.S. PATENT DOCUMENTS

| | | | |
|---|---|---|---|
| 2,074,959 | 3/1937 | Guest | 73/82 |
| 3,171,571 | 3/1965 | Daniels | 222/105 X |
| 3,235,138 | 2/1966 | Bull | 222/263 |
| 3,265,254 | 8/1966 | Carter et al. | 222/386.5 |
| 3,372,725 | 2/1968 | Voorhees | 150/49 |
| 3,417,901 | 12/1968 | Sands | 222/95 |
| 3,756,367 | 9/1973 | Mitchell et al. | 222/386.5 X |
| 4,256,150 | 3/1981 | Möckesch | 222/386.5 X |
| 4,280,637 | 7/1981 | Runciman | 222/39 |
| 4,516,692 | 5/1985 | Croley | 222/105 |
| 4,516,693 | 5/1985 | Gaston | 222/183 X |
| 4,585,143 | 4/1986 | Fremow et al. | 222/105 X |
| 4,586,628 | 5/1986 | Nittel | 220/470 |
| 4,919,306 | 4/1990 | Heaps, Jr. et al. | 222/105 |
| 4,960,227 | 10/1990 | Coleman | 222/94 |
| 4,996,760 | 3/1991 | Coleman | 29/454 |
| 5,064,096 | 11/1991 | Illing et al. | 222/185 X |
| 5,067,636 | 11/1991 | Pfeiffer et al. | 222/105 |

FOREIGN PATENT DOCUMENTS

| | | | |
|---|---|---|---|
| 0273102 | 7/1988 | European Pat. Off. | 222/105 |

*Primary Examiner*—Andres Kashnikow
*Assistant Examiner*—Kenneth De Rosa
*Attorney, Agent, or Firm*—Jack M. Wiseman

[57] ABSTRACT

A bulk material container includes a shell. Disposed in the shell is a flexible liner for containing material to be dispensed. The upper wall of the flexible liner is clamped or pressed between the rim flange at the top of the shell and the rim flange of a removable top for the container. In a modified bulk material container, the top wall of the flexible liner is detachably secured to the underside of a top on the shell by means of interlocking metallic hook and loop tapes. The discharge end of a spout for the flexible liner through which material is dispensed is extended outwardly to form a lip. The lip of the discharge spout of the flexible liner is detachably secured between a flange of an outlet fitting and a confronting flange of a discharge fitting. The outlet fitting is welded to the wall of the shell and the discharge fitting is secured to the outlet fitting by nuts and bolts. The lip of the spout is sandwiched between the flange of the outlet fitting and the flange of the discharge fitting.

7 Claims, 4 Drawing Sheets fig-1
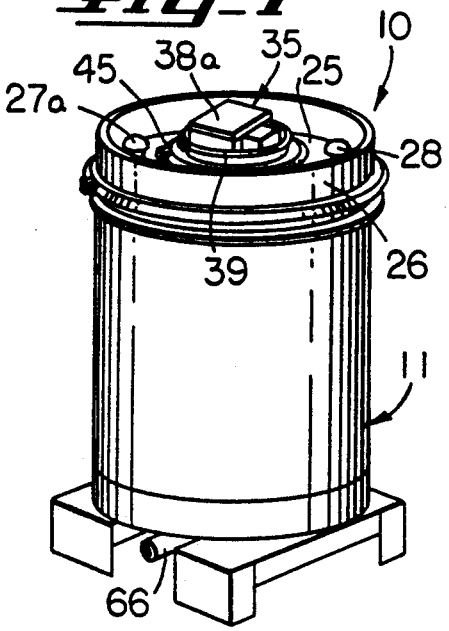
fig-2
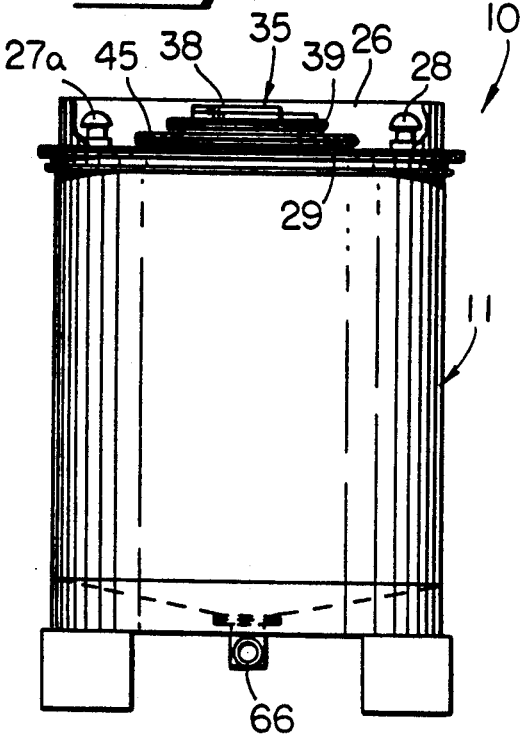
fig-4
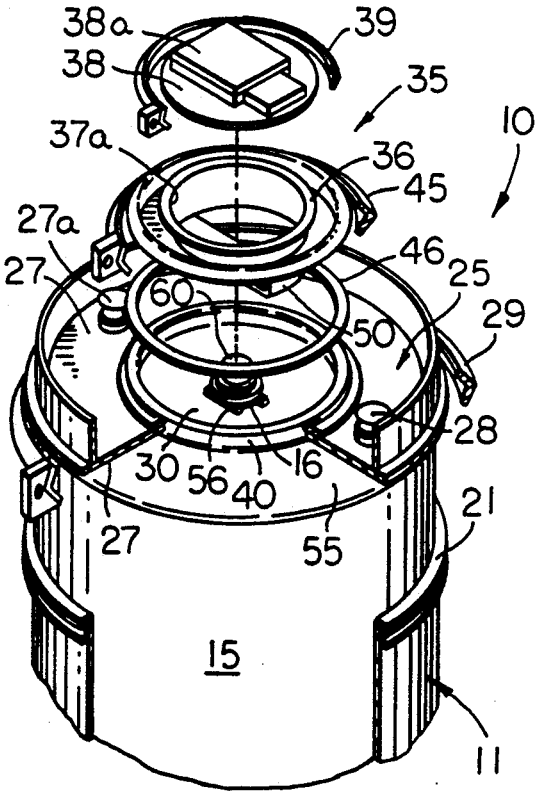
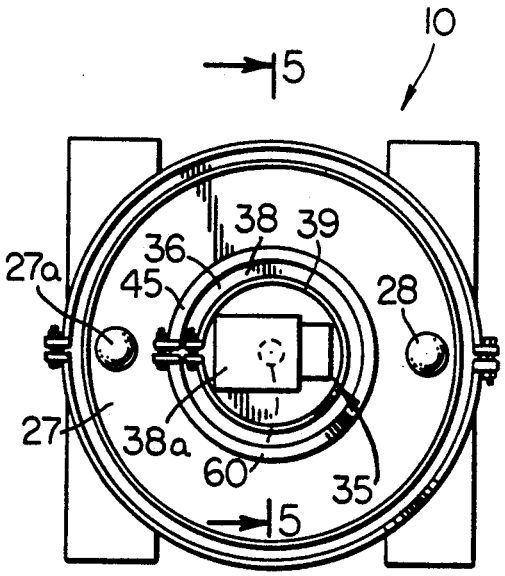
fig-3 fig_6
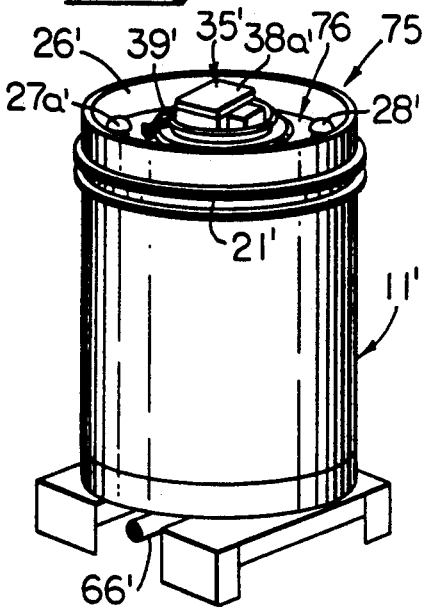
fig_7
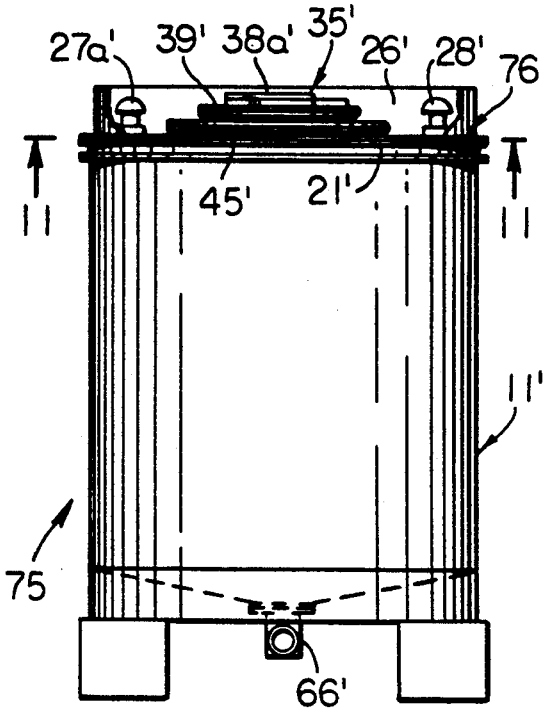
fig_9
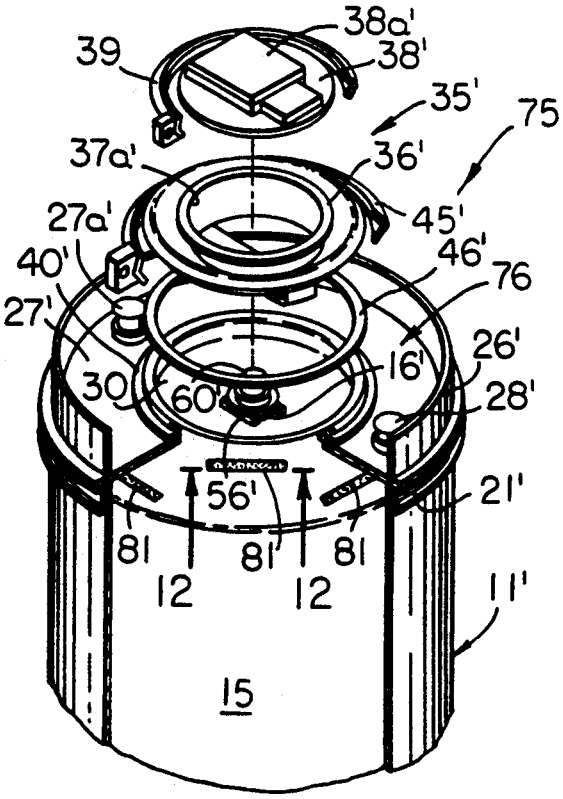
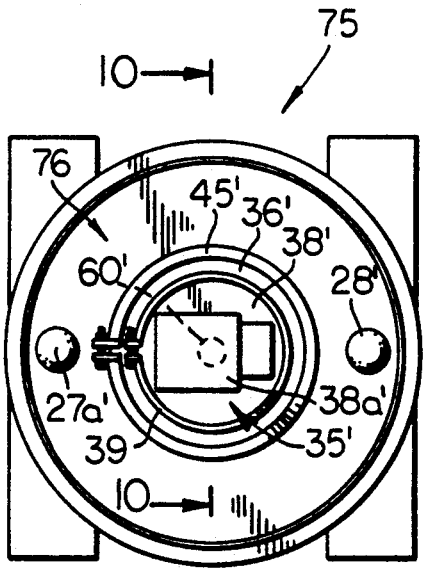
fig_8

BULK MATERIAL CONTAINER WITH A FLEXIBLE LINER

This is a continuation of copending application Ser. No. 07/718,248 filed on Jun. 20, 1991 now abandoned.

BACKGROUND OF THE INVENTION

The present invention relates in general to a bulk container, and more particularly to a bulk material container having a flexible liner.

In the U.S. Pat. No. 4,960,227, to Coleman issued on Oct. 2, 1990, for Bulk Material Container With A Flexible Liner, there is disclosed a bulk material container in which strings are fixedly secured to a fitting at the top of the flexible liner. The strings are clamped or pressed between a manhole cover and a flange along the neck of a shell of the container. In another embodiment, a sleeve of the flexible liner is clamped or pressed between the manhole cover and a flange along the neck of the shell surrounding the manhole.

Also disclosed in said U.S. Pat. No. 4,960,227 is a bottom outlet fitting for the container which has a flange. The flange is adapted to form a fluid tight seal with a discharge fitting at the bottom of the container. The bottom outlet fitting is disposed in threaded engagement with a threaded sleeve. Continued movement of the threaded sleeve within the bottom outlet fitting urges the flange of the bottom outlet fitting into sealing engagement with the discharge fitting. A sealing ring is disposed between the bottom outlet fitting and the threaded sleeve. Continued movement of the threaded sleeve within the bottom outlet fitting compresses the sealing ring for forming a seal between the bottom outlet fitting and the sleeve.

The above disclosure has also been made in U.S. Pat. No. No. 4,996,760, to Coleman, issued on Mar. 5, 1991, for Bulk Material Container With A Flexible Liner and in pending application, Ser. No. 07/533,098, filed on Jun. 4, 1990, by Clarence B. Coleman for Bulk Material Container With A Flexible Liner and in pending application, Ser. No. 694,384, filed on May 1, 1991, for A Bulk Material Container With A Flexible Liner. The present application, the cited pending applications and the cited patents have a common assignee.

In the U.S. Pat. No. 4,516,692, to Croley, issued on May 14, 1985, for Disposable Assembly For Liquids Or Semi-Liquids In Bulk, there is disclosed a disposable container of fiberboard. A plastic flexible bag containing material to be dispensed is disposed in the plastic bag. The plastic bag includes a neck. For holding the plastic bag in the upright position, the neck of the bag is clamped by rings against an upper stationary wall fixed to the shell of the container. The fixed wall of the shell has a suitable opening to receive the neck of the flexible bag.

In my copending applications, Ser. Nos. 07/235,979 and 07/705,954 filed, respectively, on Aug. 25, 1988, and on May 28, 1991, for Container With Inflatable Vessel For Controlling Flow Of Liquid Or Viscous Material, there is disclosed a collapsible plastic vessel containing a product to be dispensed. The plastic bag includes a neck that extends through the cover of the bulk material container. During the dispensing of the product, the neck of the plastic vessel is in close fit relation with a product dispensing tube. While the shipping plug is inserted in the neck of the plastic vessel, a retainer clip holds the neck of the plastic vessel in an upright position.

The U.S. Pat. No. 3,417,901, to Sands, issued on Dec. 24, 1968, for Reusable Pressurized Dispensing Device discloses a valve body with an annular detent and a ring for clamping a bag containing liquid to be dispensed secured at the top of the container.

The U.S. Pat. No. 3,265,254, to Carter et al., issued on Aug. 9, 1966, for Stacked Barrels Containing Collapsible Bags discloses a collapsible bag with a neck which is secured to the central portion of a removable cap.

In the U.S. Pat. No. 4,280,637, to Runciman, issued on Jul. 28, 1981, for Constant Feed Device, there is disclosed a membrane secured at its lower end to a base.

In the U.S. Pat. No. 3,372,725, to Voorhees, issued on Mar. 12, 1968, for Collapsible Container Modified, there is disclosed a flexible wall fastened to a base pan. The flexible wall is disposed between the pan surface and a flange.

In the U.S. Pat. No. 4,586,628, to Nittel, issued on May 6, 1986, for Resilient Inner Liner For Lining Of Transport Or Storage Containers, there is disclosed a liner for a container. The liner is installed through a bottom opening of the container. A string or wire is fastened at the upper end of the liner to pull the liner to an upper opening of the container. A feed pipe is bonded to the lower end of the container. A lower flange on the feed pipe abuts against the wall defining the opening at the lower end of the container.

The U.S. Pat. No. 2,074,959, to Guest, issued on Mar. 23, 1937, for Fuel Tank Gauge, discloses bellows. The upper end of the bellows is connected to the underside of a removable top.

In the U.S. Pat. No. 3,235,138, to Bull, issued on Feb. 15, 1966, for Dispensing Container, there is disclosed a plastic bag secured to the underside of a lid.

SUMMARY OF THE INVENTION

An object of the present invention is to provide a bulk material container with a flexible liner in which the outlet of the flexible liner is sealed by being clamped between a flange of an outlet fitting secured to the shell of the container and a flange of a discharge fitting.

Another object of the present invention is to provide a bulk material container with a flexible liner disposed therein for containing material and in which the upper wall of the flexible liner is clamped or pressed between the rim flange of the shell of the container and the rim flange of a removable top or cover for the container.

Another object of the present invention is to provide a bulk material container with a flexible liner disposed therein for containing material and in which the upper wall of the flexible liner is detachably secured to the top of the container by interlocking hook and loop tapes.

Another object of the present invention is to provide a bulk material container with a flexible liner disposed therein for containing material and in which the upper wall of the flexible liner is clamped or pressed between the rim flange of the shell of the container and the rim flange of a removable top or cover for the container, while a neck of the flexible liner extends through an opening in the removable top.

Another object of the present invention is to provide a bulk material container with a flexible liner disposed therein for containing material and in which the upper wall of the flexible liner is detachably secured to the top of the container by interlocking hook and loop tapes, while a neck of the flexible liner extends through an opening in the removable top.

BRIEF DESCRIPTION OF THE DRAWINGS

FIG. 1 is a perspective view of a bulk material container with a flexible liner embodying the present invention.

FIG. 2 is a fragmentary front elevation view of the bulk material container shown in FIG. 1.

FIG. 3 is a plan view of the bulk material container shown in FIGS. 1 and 2.

FIG. 4 is a fragmentary exploded view of the upper section of the bulk material container shown in FIGS. 1-3.

FIG. 6 is a perspective view of a bulk material container with a flexible liner, which is a modification of the bulk material container shown in FIGS. 1-5.

FIG. 7 is a fragmentary front elevation view of the bulk material container shown in FIG. 6.

FIG. 8 is a plan view of the bulk material container shown in FIGS. 6 and 7.

FIG. 9 is a fragmentary exploded view of the upper section of the bulk material container shown in FIGS. 6-8.

DESCRIPTION OF THE PREFERRED EMBODIMENTS

Figure 5:
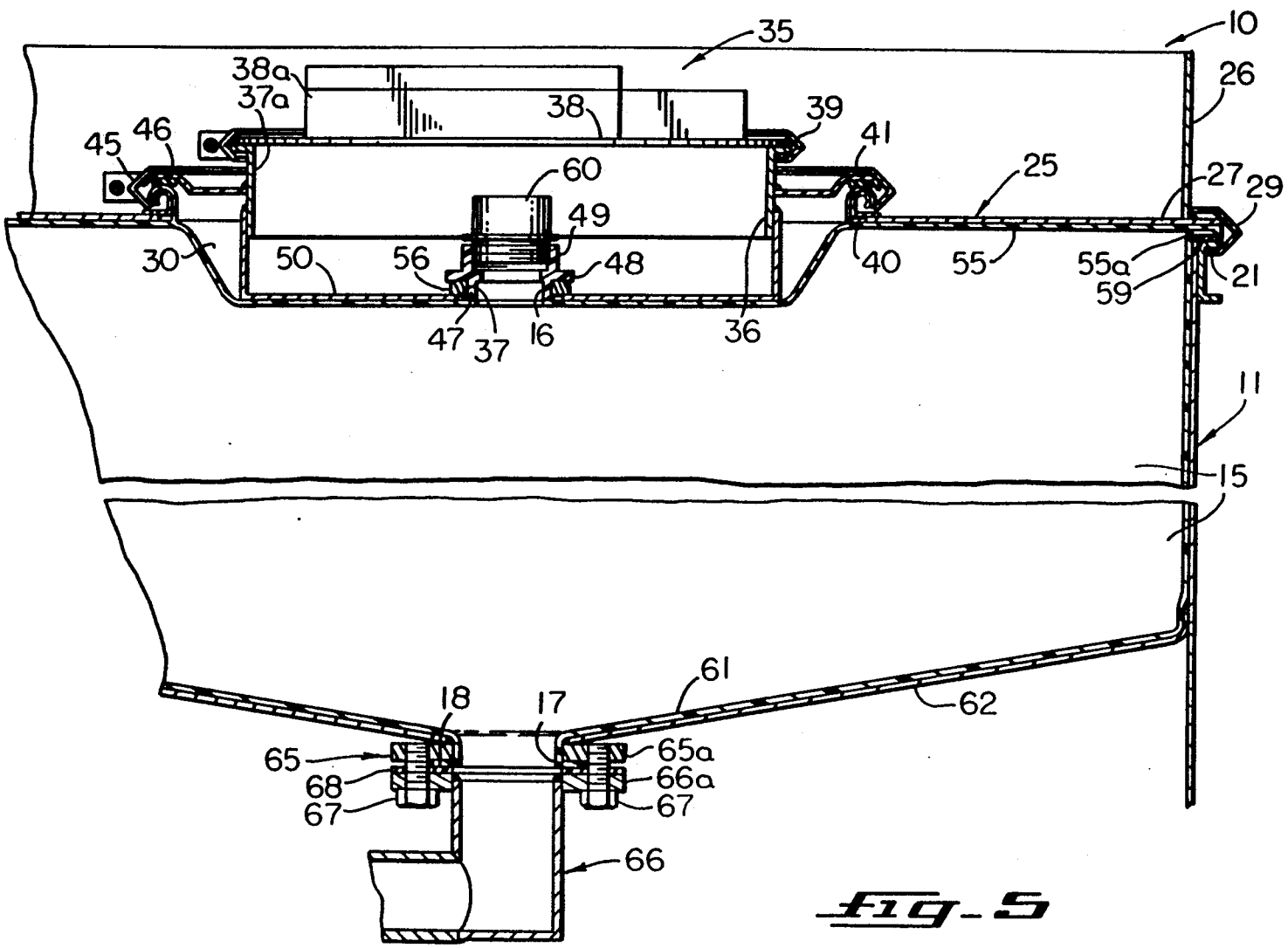
FIG. 5 is an enlarged, fragmentary, vertical sectional view of the bulk material container shown in FIGS. 1-4 taken along line 5-5 of FIG. 3.

Illustrated in FIGS. 1-5 is a bulk material container 10 embodying the present invention. The bulk material container 10 comprises a well-known shell 11 that is made of suitable material such as mild steel, aluminum or the like. Disposed within the shell 11 is a suitable flexible liner 15 (FIGS. 4 and 5) for containing bulk material to be dispensed, such as liquid or viscous material. The flexible liner 15, in the preferred embodiment, is made of polyvinyl chloride or polyethylene. At the top of the flexible liner 15 is a suitable flexible neck 16 (FIG. 5) through which bulk material is deposited into the flexible liner 15. At the bottom of the flexible liner 15 is a suitable flexible dispensing outlet or flexible spout 17 (FIG. 5) through which material is discharged from the flexible liner 15. The flexible liner 15, its neck 16 and its spout 17 are, in the preferred embodiment, integrally formed and made of the same material. The flexible spout 17 at the distal end thereof is foldable or extendable outwardly to form a circumferential edge or lip 18. In the preferred embodiment, the flexible liner 15 is a fully enclosed vessel with the inlet neck 16 and the spout 17.

The shell 11 includes a suitable rim flange 21 at the upper extremity thereof (FIGS. 4 and 5). Seated on the rim flange 21 of the shell 11 is a suitable removable top or cover 25 for the container 10. The removable top 25 is made of suitable material, such as mild steel, aluminum or the like. Projecting upwardly from the removable top 25 inboard of the rim flange 21 of the shell 20 is a well-known stacking ring 26, which is made of suitable material, such as mild steel, aluminum or the like. The stacking ring 26, in the exemplary embodiment, is fixedly secured to the removable top 25. The top 25 includes a rim flange 27 that is disposed above and coextensive with the rim flange 21 of the shell 11 (FIG. 5). A suitable pressure vent 27*a* and a suitable vacuum vent 28 are suitably coupled to the removable top 25. A well-known locking ring 29 with an angular or arcuate inner surface removably secures the removable top 25 to the top of the shell 11. In so doing, the rim flange 27 of the top 25 is above and confronting the rim flange 21 of the shell. In the exemplary embodiment, the locking 29 is a well-known split lock ring and is made of suitable material, such as mild steel, aluminum or the like.

Formed in the removable top 25 is a suitable opening 30 (FIG. 5). Disposed within the opening 30 is a removable cover 35. The cover 35 has a hollow cylindrical body 36 with an axial opening 37 at the bottom and an increased diameter opening 37*a* at the top thereof. Extending upwardly from the removable top 25 outboard of the opening 30 is an annular neck 40, which is secured to the removable top 25 by suitable means, such as welding. Projecting from the hollow cylindrical body 36 of the cover 35 is an annular generally arcuate flange 41 that seats on the arcuate neck 40 of the removable top 25 in an overlying relation. The cover 35 is made of suitable material, such as mild steel, aluminum or the like.

For removably securing the cover 35 to the removable top 25, a suitable split lock ring 45 with an inwardly facing arcuate or angular wall that engages the arcuate flange 41 of the cover 35 to urge the flange 41 of the cover 35 in locking engagement with the annular neck 40 of the removable top 25. The lock ring 45 is made of suitable material, such mild steel, aluminum or the like. Disposed within the annular flange 41 of the cover 35 is a suitable gasket 46 that is caused to adhere to the inner arcuate surface of the flange 41 by a suitable resin or other suitable adhesive. The gasket 46 forms a suitable seal between the annular flange 41 of the cover 35 and the annular neck 40 of the removable top 25. A disc-like lid 38 of the cover 35 is removably secured to the hollow cylindrical body 36 of the cover 35 by a suitable split lock ring 39. The split lock ring 39 is made of suitable material, such as mild steel or aluminum. Fixedly secured to the top of the lid 38 is a solid quadrilateral body 38*a* of the cover 35, which serves as a suitable handle.

The neck 16 of the flexible liner 15 extends into the axial opening 37 of the cover 35 (FIG. 5). The neck 16 of the flexible liner 15, in the preferred embodiment, is formed with an upright hollow square wall 47 in cross-section, which terminates at a horizontal shoulder 48 along the perimeter of the neck 16. At the distal end of the neck 16 is an upright hollow wall 49 which terminates at the horizontal shoulder 48. At the bottom of the hollow cylindrical body 36 is a narrow plate 50 (FIGS. 4 and 5) in which the opening 37 is formed and through which passes the neck 16. The plate 50 of the hollow cylindrical body 36 of the cover 35 engages a top wall 55 of the flexible liner 15 (FIG. 5). The top wall 55 of the flexible liner has a cylindrical configuation in the exemplary embodiment. The portion of the top wall 55 of the flexible liner 15 on which the cover 35 engages is the portion thereof radially outward of the neck 16.

For holding the neck 16 of the flexible liner 15 in an upright position, a suitable retainer clip 56 (FIGS. 4 and 5) of the suitable material, such as mild steel, is disposed between the horizontal shoulder 48 and the plate 50 of the cylindrical body 36 of the cover 35. The retainer clip 56 has a U-shaped configuration conforming to the shape of the perimeter of the upright wall 47 of the neck 16. Disposed within the opening defined by the upright wall 49 of the neck 16 is a suitable plug 60, which may be in the form of a pressure vent.

When the removable top 25 is secured to the shell 11 by the lock ring 29, the top wall 55 of the flexible liner 15 is clamped or pressed between the rim flange 21 of the shell 11 and the rim flange 27 of the removable top 25. The top wall 55 of the flexible liner 15 is folded at 55*a* or extended circumferentially to form a circumferential lip 55*a* disposed over the rim flange 21 of the shell 11 and under the rim flange 27 of the removable top 25. Thus, the flexible liner 15 is held in the upright state within the shell 11 by being removably secured between the shell 11 and the removable top 25 in the vicinity of the rim flange 21 of the shell 11. A suitable gasket or ring seal 59, such as a neoprene gasket, is disposed between the rim flange 21 of the shell 11 and the top wall 55 of the flexible liner 15.

As previously described, the flexible liner 15 includes a spout 17 (FIG. 5) at the lower wall 61 thereof. The spout 17 is flexible and is folded or extended at its distal end to form the circumferential lip 18. The flexible liner 15 at the wall 61 thereof, in the exemplary embodiment, follows the contour of a bottom wall 62 of the shell. Secured to the bottom wall 62 of the shell 11 in communication with an opening formed therein is a bottom outlet fitting 65. The bottom outlet fitting 65 is secured to the bottom wall 62 of the shell 11 by suitable means, such as by welding.

Removably attached to the bottom outlet fitting 65 is a suitable discharge fitting 66. The outlet fitting 65 has an annular flange 65*a* and the discharge fitting 66 has an annular flange 66*a*. The annular flanges 65*a* and 66*a* are detachably secured together by suitable means, such as bolts 67. Clamped or pressed between the flanges 65*a* and 66*a* is the circumferential lip 18 of the spout 17 of the flexible liner 15. A suitable gasket or ring seal 68., such as a neoprene gasket, is disposed between circumferential lip 18 of the flexible liner 15 and the flange 66*a* of the discharge fitting 66. Thus, the discharge fitting 66 is in sealing engagement with the bottom outlet fitting 65. While the dispensing assembly is disclosed herein to be located at the bottom wall 62 of the shell 11, it is apparent that the dispensing assembly can be located along the cylindrical outer wall of the shell 11 in the vicinity of the bottom thereof.

Illustrated in FIGS. 6–10 is a bulk material container 75 which is a modification of the bulk material container 10 shown in FIGS. 1–5. Parts of the bulk material 75 similar to corresponding parts of the bulk material container 10 will be shown with the same reference numeral but will have a prime suffix.

The bulk material container 75 differs from the bulk material container 10 in that the top wall 55' of the flexible liner 15' is not clamped or pressed between the rim flange of the shell and the rim flange of a cover for the bulk material container. According to the invention embodied in bulk material container 75, the upper wall 55' of the flexible liner 15' is secured to the underside of the top 26 by means of interlocking hook and loop tapes 80 and 81 (FIGS. 10 and 11), preferably metallic hook and loop tapes. The interlocking metallic hook and loop tapes 80 and 81 may be purchased commercially as VELCRO tapes. In the preferred embodiment, the loop tape 80 is secured to the top 76 and the hook tape 81 is secured to the upper wall 55' of the flexible liner 15'.

In the exemplary embodiment, suitable adhesive material, such as WILL HOLD cement manufactured and sold by Dap, Inc., is applied between the underside of the top 76 and the backing of the strips of loop tapes 80 to cause the strips of loop tapes 80 to adhere to the underside of the top 76. Similarly, in the exemplary embodiment, suitable adhesive material, such as WILL HOLD cement manufactured and sold by Dap, Inc. is applied between the wall 55' of the flexible liner 15' and the backing of the strips of hook tapes 81 to cause the hook tapes 81 to adhere to the upper wall 55' of the flexible liner 15'. In another exemplary embodiment, the backing of the strips of hook tapes 81 are heat sealed to the upper wall 55' of the flexible liner 15' to cause the strips of hook tapes 81 to adhere to the upper wall 55' of the flexible liner 15'. Adhesive material that may be suitably employed to cause the strips of loop and hook tapes 80 and 81, respectively, to adhere to the top 76 and the upper wall 55' of the liner 15', respectively, is generally a pressure sensitive contact cement.

Figures 10, 11, 12:
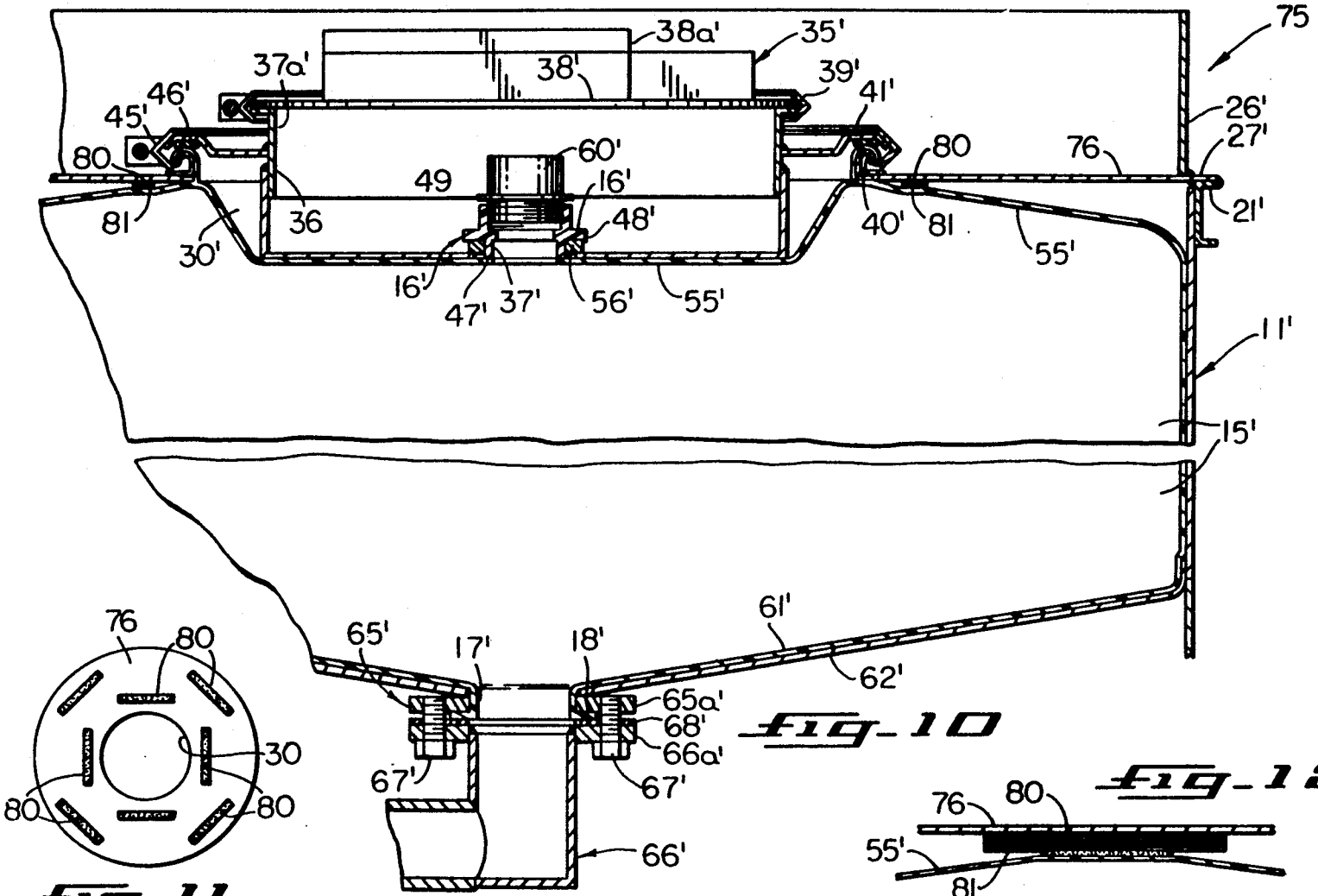
FIG. 10 is an enlarged, diagrammatic fragmentary, vertical sectional view of the bulk material container shown in FIGS. 6-9 taken along line 10—10 of FIG. 8.
FIG. 11 is a diagrammatic horizontal sectional view reduced in size of the bulk material container shown in FIGS. 6-11 taken along line 11—11 of FIG. 7.
FIG. 12 is an enlarged diagrammatic horizontal sectional view taken along line 12—12 of FIG. 9.

In the exemplary embodiment, the strips of loop tapes 80 are disposed radially outward from the opening 30' at various radial distance groupings (FIG. 11). The strips of hook tapes 81 are arranged on the upper wall 55' of the liner 15' to interlock with the strips of loop tapes 80 fixed to the underside of the top 76 (FIGS. 10 and 12). In the preferred embodiment, cement is applied centrally and not applied to the ends of the strips of hook tapes 81 to enable the top wall 55' of the flexible liner 15' to be freely movable relative to the ends of the strips of the hook tapes 81 (FIG. 12). In this manner, the force applied to hook tapes 81 are applied centrally of the length thereof. Thus, the operator in removing the upper wall 55' of the flexible liner 15' from the top 76 applies the load or pull centrally of the hook tapes 81 as viewed from the lengthwise dimension of the hook tapes 81 to facilitate the removal and the installation of the flexible liner 15' in the shell 11'.

What is claimed is:

1. A bulk material container comprising:

(a) a shell with a rim flange surrounding an opening at the upper extremity of said shell;

(b) a removable top detachably secured to said shell at the upper extremity of said shell, said removable top having a rim flange overlying the rim flange of said shell and having an opening;

(c) a single flexible liner disposed in said shell for containing bulk material, said flexible liner comprising a top wall extending above said rim flange of said shell, said top wall of said flexible liner being removably secured between said rim flange of said shell and said rim flange of said removable top; and (d) a detachable lock ring for urging said rim flange of said removable top and said rim flange of said shell into clamping engagement with said top wall of said flexible liner, (e) said flexible liner comprising a neck through which material is discharged into said flexible liner, said neck of said flexible liner extending from said top wall of said flexible liner into the opening of said removable top.

2. A bulk material container as claimed in claim 1 and comprising a removable cover having a hollow body with the lower section of said hollow body disposed within said opening of said removable top and with an upper section of said hollow body overlying said removable top, said hollow body being formed with a central opening through which passes the neck of said flexible liner.

3. A bulk material container as claimed in claim 2 wherein said shell includes a wall at the lower extremity of said shell, said wall at the lower extremity of said shell being formed with a discharge opening, said bulk material container comprising an outlet fitting secured to said wall at the lower extremity of said shell in communication with said discharge opening, said outlet fitting being formed with an outwardly directed flange at the discharge end thereof, said flexible liner being formed with a spout for discharging material contained in said flexible liner through said outlet fitting, said spout at its distal end being formed with an outwardly extending lip confronting the flange of said outlet fitting, said bulk material container comprising a discharge fitting having an outwardly directed flange confronting the lip of said spout, and threaded means received by said outwardly directed flange of said outlet fitting and said outwardly directed flange of said discharge fitting, said threaded means having an axis disposed perpendicular to said flanges, said threaded means drawing said flange of said outlet fitting and said flange of said discharge fitting toward one another along said axis for sandwiching securely said lip of said spout between said flange of said outlet fitting and said flange of said discharge fitting.

4. A bulk material container as claimed in claim 3 and comprising a seal ring disposed between said flange of said outlet fitting and the flange of said discharge fitting for providing a fluid tight seal therebetween.

5. A bulk material container comprising:

(a) a shell with a rim flange surrounding an opening at the upper extremity of said shell;

(b) a removable top detachably secured to said shell at the upper extremity of said shell, said removable top having a rim flange overlying the rim flange of said shell and having an opening;

(c) a single flexible liner disposed in said shell for containing bulk material, said flexible liner comprising a top wall extending above said rim flange of said shell, said top wall of said flexible liner being removably secured between said rim flange of said shell and said rim flange of said removable top;

(d) a detachable lock ring for urging said rim flange of said removable top and said rim flange of said shell into clamping engagement with said top wall of said flexible liner, (e) said flexible liner comprising a neck through which material is discharged into said flexible liner, said neck of said flexible liner extending from said top wall of said flexible liner into the opening of said removable top; and (f) a removable cover having a hollow body with the lower section of said hollow body disposed within said opening of said removable top and with an upper section of said hollow body overlying said removable top, said hollow body being formed with a central opening through which passes the neck of said flexible liner, (g) said removable top including a neck surrounding said opening of said removable top, said bulk material container comprising a cover lock ring engaging said hollow body of said cover and the neck of said removable top for removably securing said cover to said removable top.

6. A bulk material container comprising:

(a) a shell having a wall formed with a discharge opening;

(b) an outlet fitting secured to said wall in communication with said discharge opening, said outlet fitting being formed with an outwardly directed flange at the discharge end thereof;

(c) a flexible liner being formed with a spout for discharging material contained in said flexible liner through said outlet fitting, said spout at its discharge end being formed with an outwardly extending lip confronting the flange of said outlet fitting;

(d) a discharge fitting having an outwardly directed flange confronting the lip of said spout, whereby said lip of said spout being disposed between said flange of said outlet fitting and the flange of said discharge fitting; and (e) threaded means received by said outwardly directed flange of said outlet fitting and said outwardly directed flange of said discharge fitting, said threaded means having an axis disposed perpendicular to said flanges, said threaded means drawing said flange of said outlet fitting and said flange of said discharge fitting toward one another along said axis for sandwiching securely said lip of said spout between said flange of said outlet fitting and said flange of said discharge fitting.

7. A bulk material container comprising:

(a) a shell with a rim flange surrounding an opening at the upper extremity of said shell;

(b) a removable top detachably secured to said shell at the upper extremity of said shell, said removable top having a rim flange overlying the rim flange of said shell and have an opening;

(c) a flexible liner disposed in said shell for containing bulk material, said flexible liner comprising a top wall extending above said rim flange of said shell, said top wall of said flexible liner being removably secured between said rim flange of said shell and said rim flange of said removable top;

(d) a detachable lock ring for urging said rim flange of said removable top and said rim flange of said shell into clamping engagement with said top wall of said flexible liner, (e) said flexible liner comprising a neck through which material is discharged into said flexible liner, said neck of said flexible liner extending from said top wall of said flexible liner into the opening of said removable top; and (f) a removable cover having a hollow body with the lower section of said hollow body disposed within said opening of said removable top and with an upper section of said hollow body overlying said removable top, said hollow body being formed with a central opening through which passes the neck of said flexible liner, (g) said removable top including a neck surrounding said opening of said removable top, said bulk material container comprising a cover lock ring engaging said hollow body of said cover and the neck of said removable top for removably securing said cover to said removable top.

* * * * *